United States Patent [19]

Gravier

[11] Patent Number: 4,977,770

[45] Date of Patent: Dec. 18, 1990

[54] AUTOMATABLE BENDING MACHINE HAVING CRENELATED ROLLS

[75] Inventor: Michel Gravier, Aubergenville, France

[73] Assignee: Jammes Industrie S.A., Cebazat, France

[21] Appl. No.: 407,655

[22] Filed: Sep. 15, 1989

[30] Foreign Application Priority Data

Oct. 5, 1988 [FR] France ..... 88 13381

[51] Int. Cl.[5] ..... B21D 5/14

[52] U.S. Cl. ..... 72/175; 72/173; 72/169

[58] Field of Search ..... 72/170, 173–175, 72/169, 165, 163

[56] References Cited

U.S. PATENT DOCUMENTS

| | | | |
|---|---|---|---|
| 2,140,404 | 12/1938 | Kane | 72/173 |
| 2,675,849 | 4/1954 | Greenshields | 72/173 |
| 2,882,767 | 4/1959 | Chatfield | 72/175 |
| 4,133,197 | 1/1979 | Allen | 72/175 |
| 4,249,406 | 2/1981 | Anderson | 72/174 |

FOREIGN PATENT DOCUMENTS

| | | | |
|---|---|---|---|
| 551321 | 1/1958 | Canada | 72/170 |
| 2411647 | 8/1979 | France | 72/170 |
| 2528335 | 3/1985 | France . | |
| 74522 | 12/1970 | German Democratic Rep. | 72/165 |

*Primary Examiner*—Daniel C. Crane
*Attorney, Agent, or Firm*—Michael Ebert

[57] ABSTRACT

A bending machine for shaping a flat sheet into a cylinder or cone by passing the sheet between a support roll and a train crenelated rolls having parallel axes. The crenelated rolls are subjected to pressure by a train of press rolls having axes parallel to those of the crenelated rolls.

7 Claims, 3 Drawing Sheets

AUTOMATABLE BENDING MACHINE HAVING CRENELATED ROLLS

BACKGROUND OF INVENTION

1. Field of Invention:

The present invention relates generally to machines adapted to deform material, and more particularly to a bending machine for bending a flat sheet of material into a cylinder or cone.

2. Status of Prior Art:

Bending machines are known in which the bending of the sheet results from passing the sheet between a support roll and an assembly of crenelated rolls with axes parallel to the axis of the support roll and generally located above it. The cylindrical surfaces of the crenelated rolls penetrate into each other and the radius of bend is defined by whether the support roll is closer to or further from the assembly of crenelated rolls.

The main problem posed by such bending machines is the flexing of the rolls and, more particularly, of the support roll which behaves in the manner of a beam that is necessarily rather long and thin. One solution to this problem is to impose a corresponding flexure on the opposing rolls, in the present case, the crenelated rolls. In order to effect this solution, but also for other reasons, there has also been proposed the use of a press roll of a diameter comparable to that of the support roll and of rollers which exert a differentiated pressure on the possibly inflected press roll, due to which the crenelated rolls merely transmit the pressure of the press roll, without their bearings being subjected to any substantial force.

This prior art is clearly described in the French publications FR-A No. 2 411 647 and FR-A No. 2 528 335, both in the name of the present applicant. The improved bending machine disclosed in the last-mentioned publication has given excellent results as to the precision of the radius of bend obtained. However, due to the biaxial displacement of the trains of crenelated rolls, this machine lends itself poorly to high-output work.

SUMMARY OF INVENTION

The main object of the present invention is to provide an automatically-operated bending machine which can be combined with a welding machine.

Another object of the invention is to provide a more precise means for adjusting the flexure imposed on the crenelated rolls in order to compensate for the flexing of the support roll.

Still another object of the invention is to distribute the load imposed on the crenelated rolls while guiding them in rotation in order further to decrease the load on their bearings.

Briefly stated, in a bending machine according to the present invention for shaping a flat sheet into a cone or cylinder in which the bending of the sheet results from its passage between a support roll and a train of crenelated rolls with parallel axes, the crenelated rolls are subjected to the pressure of a train of three press rolls having axes parallel to the axes of the crenelated rolls; namely, a central press roll which simultaneously presses on each of the crenelated rolls and so-called lateral rolls, each of which is pressed against a respective crenelated roll. The line of contact between the press rolls and the crenelated rolls is located above the plane defined by the axes of the crenelated rolls. The axes of the rolls of the assembly, referred to as moveable assembly of the press rolls and of the crenelated rolls, is substantially fixed with respect to each other. Preferably the contact line of the press rolls with the crenelated rolls is located about 45° above the plane defined by the axes of the crenelated rolls.

Advantageously, in accordance with another significant feature of the invention, the support rolls and the crenelated rolls are arranged in a plurality of coaxial trains, the ends of each train being supported by end support plate bearings and intermediate points in the train by intermediate support plate bearings integral with a beam which is movable only in a vertical direction. This gives rise to a more judicious distribution of the forces and a substantial relief of pressure on the bearings of the crenelated rolls.

In accordance with another feature of the invention, the adjustment of the radius of rolling results from a precise vertical displacement of the assembly of rolls perpendicular to their axes. This displacement is induced by a displacement parallel to the axes of the rolls of at least one first ramp resting on a frame of the machine relative to at least one second ramp integral with the bearings of the shafts of the rolls of the moveable assembly. This feature gives rise to a better reproducibility of positioning of the rolled sheet at the end of the operation, which, in the final analysis, is conducive to automating of the operations.

Still another advantageous feature resides in a plurality of first ramps provided in the edge of a bar, called the ramp bar. An identical plurality of second ramps is formed by so-called "sloped" wedges which are integral with the moving beam. A preferred value of the angle formed by the plane of each ramp with the roll axes is about 6° (slope of about 10%), each sloped wedge having independent means for positioning in a direction parallel to that of the axes of the rolls. In a preferred embodiment, the means for positioning a sloped wedge is formed by a slideway having a plane parallel to the plane of the axes of the crenelated rolls and oriented at about 45° with respect of said axes.

These arrangements make possible the precise and practical adjustment of the radius of bend, and the arrangement also compensates for flexure of the support roll.

The displacement of the ramp bar in the direction of the axis of the rolls is preferably carried out by a piston-cylinder unit which is integral with the frame, the rod of which unit is connected to said bar by pairs of tension rods and cross-members. The "extended" position of the rod corresponds to the "lowered" position of the assembly of rolls, while a stop which limits the extension of the rod is mounted on the end of a threaded shaft which engages a nut of a gantry which is integral with the frame, the threaded shaft having an indexable crank.

Another feature of the invention resides in a comb, the teeth of which are tangent to the support roll and can, by rotation of the comb around the axis of the support roll, penetrate between the crenelated rolls so as to separate the linear edges of the rolled sheets. In accordance with these characteristic arrangements, the comb serves as a guide surface for the flat sheets before their passage between the rolls. A notch of a width at least equal to that of said bearing support web is arranged below the end of each tooth on the side opposite the said guide surface to define a harpoon. The end of each harpoon has at its upper part a small protruding rim. Finally, the comb is supported by a frame articulated at each of its ends around the support roll.

BRIEF DESCRIPTION OF DRAWINGS

The present invention will be better understood and the details relating to it will become evident from the following description of a bending machine according to the invention, read with reference to the figures of the accompanying drawings, in which.

DESCRIPTION OF INVENTION

Figures 1, 2, 3:
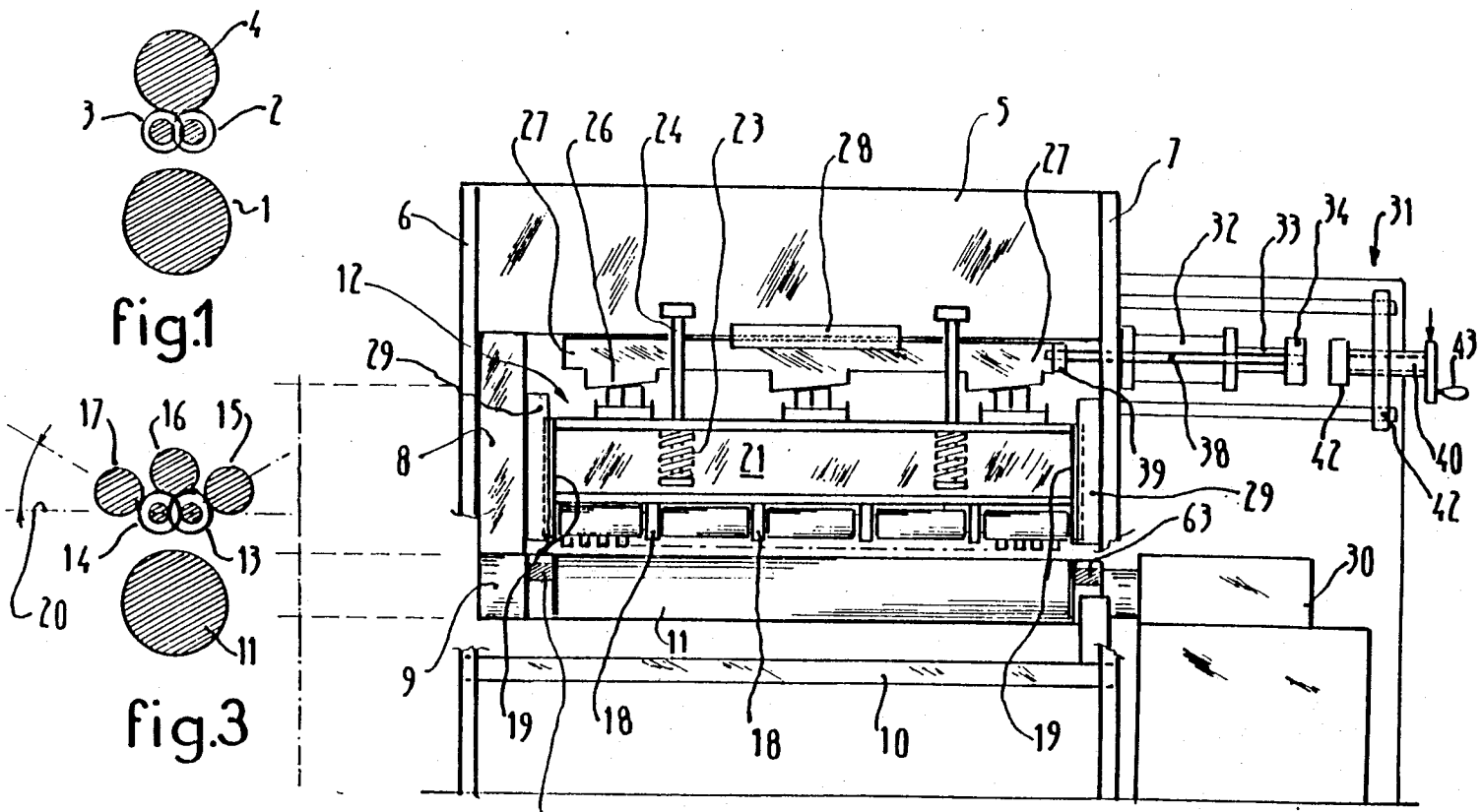
FIG. 1 is a diagrammatic view, in section, of the arrangement of the rolls in a prior art bending machine.
FIG. 2 is a view in elevation of a bending machine in accordance with the invention.
FIG. 3 shows, as compared with FIG. 1, the arrangement of the rolls in accordance with the invention.

In FIG. 1, a bending machine of the prior art type, such as described in French publication FR-A No. 2,528,335 comprises a support roll 1, two crenelated rolls 2 and 3 and a single press roll 4, differing, as is clearly apparent by comparison with FIG. 3, from the bending machine of the present invention.

In FIG. 2, a bending machine in accordance with the invention consists of a stationary frame comprising an upper beam web 5, two gantries—a front one 6 and a rear one 7—a support web 8 for a bearing 9, and a pair of guide rails 10. It is also formed of a support roll 11, which is movable only in rotation, and a movable assembly 12 including a beam 21, and, as shown in FIG. 3, the crenelated rolls (13, 14) and press rolls (15, 16, 17).

It is clear from FIGS. 2 and 3 that the press rolls and the crenelated rolls are arranged in a plurality of coaxial trains supported by intermediate support-plate bearings 18 and by end bearings 19. It also appears from FIG. 3 (see also FIG. 5) that the line of contact of the press rolls 15, 17 with the crenelated rolls 13, 14 is located about 45° above the plane 20 defined by the axes of the crenelated rolls.

Still referring to FIG. 2, it can be seen that a beam 21 is suspended from the beam web 5 by spring suspensions 23 and rods 24. Wedges, referred to as "sloped" wedges 25, are fastened to the upper flange of the beam, which is advantageously an H beam. Opposing ramps 26 are cut in the edge of a bar 27, called the ramp bar. Wedges 25 are continuously urged against ramps 26 by springs 23. The ramp bar 27 is slidable in slideways 28 parallel to the axes of the rolls (namely, horizontal in the case of a machine shown in the figures). Sliding of ramp bar 27 results in sliding of ramps 26 against wedges 25, causing vertical movement of the latter and of the movable assembly 12 to which they are securely fastened. Provided for vertical guidance of assembly 12 are slideways 29.

Shown on the right-hand side of FIG. 2 is a gear reduction motor 30 for driving support roll 11. Above motor 30 is an assembly 31 whose function is to effect adjustment of the radius of bend of the sheets. Assembly 31 comprises a cylinder-piston unit 32, the body of which is securely fastened to gantry 7. The piston rod 33 of unit 32 is connected to a first cross member 34. Cross member 34 is connected by a pair of tie rods 38 to a second cross member 39 which is firmly attached to ramp bar 27. A threaded shaft 40, coaxial with rod 33, is borne by a secondary frame 41 firmly attached to the mainframe (5, 7). One end of shaft 40 is borne by a stop 42 which acts to limit the extension of piston rod 33, while its other end carries an indexable crank 43 provided with a position indicator.

Shown on the left-hand side of FIG. 2 symbolically in dashed lines is another machine, such as a welding machine, whose operation may be coordinated with the bending machine.

Figures 6, 7, 8A, 8B, 8C, 8D:
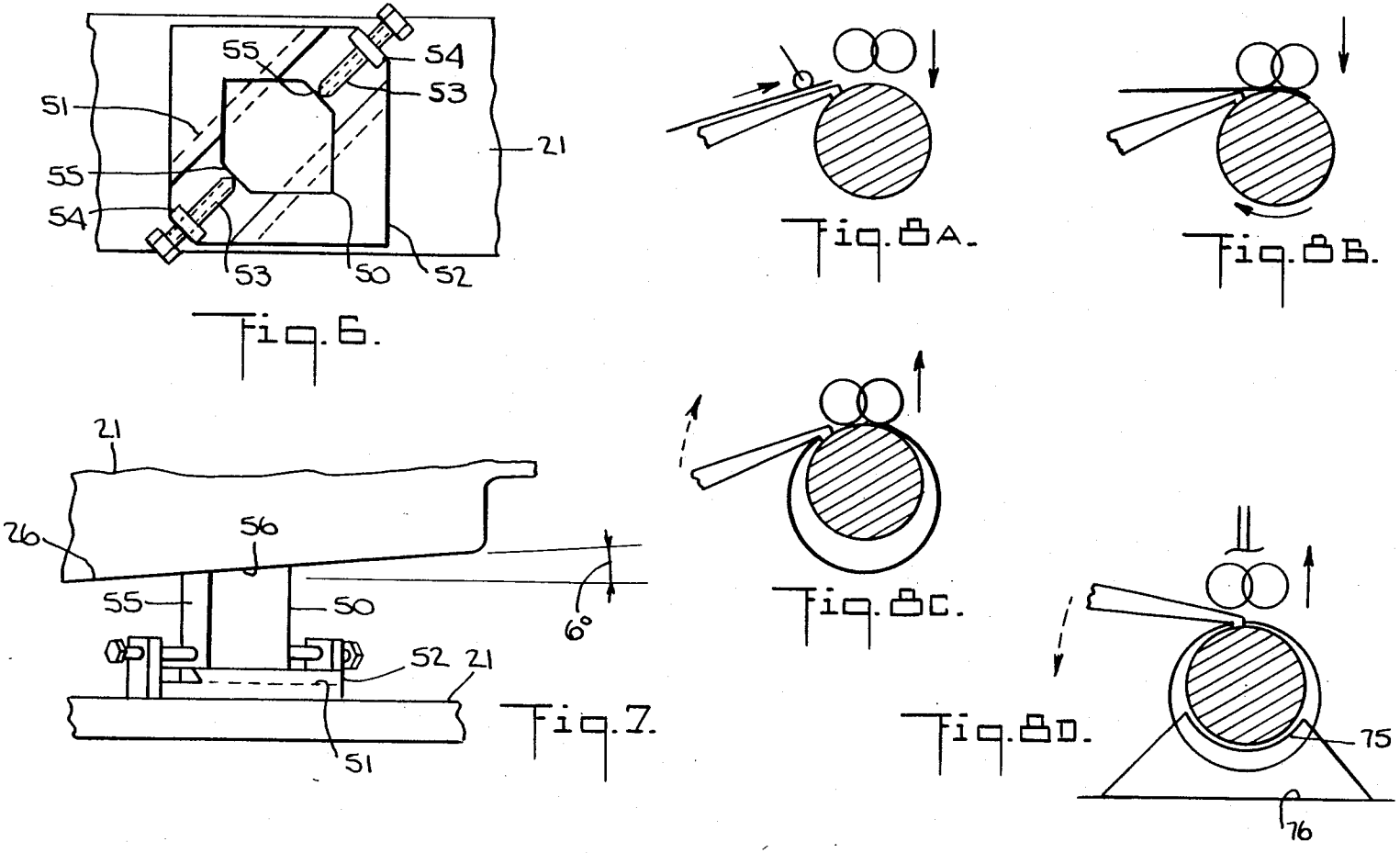
FIG. 6 illustrates in plan view one of the adjustment means for compensating for the flexure of the support roll of the bending machine of FIG. 1.
FIG. 7 is a corresponding view in elevation of the adjustment means of FIG. 6.
FIGS. 8*a*, 8*b*, 8*c*, and 8*d* diagrammatically illustrate the operation of the bending machine of the invention in successive stages.

In a preferred embodiment of the wedges, as shown in FIGS. 6 and 7, each wedge is formed of a prismatic block 50, preferably of anti-friction metal, shaped as a dovetail at its base, in order to be guided for sliding movement in a slideway 51 of corresponding shape provided in a base 52 fastened on beam 21. The slideway as is clearly visible from FIG. 6, is oriented about 45° with respect to the direction of the axes of the rolls, or else with respect to the direction of sliding of the ramp bar. The adjustment of the position of the wedge along its slideway is effected by means of two coaxial opposing screws 53 screwed in nuts 54 integrally attached to the base, the ends of the screws resting against flats 55 of the blocks.

The upper face of block 50 forms an inclined plane 56 parallel to the face of the ramps. For reasons of convenience and simplification in machining, the planes of the faces of the ramp are perpendicular to the central longitudinal plane of the ramp bar and necessarily parallel to each other.

It follows from this arrangement that a sliding movement of the block over a distance d in the slideway is equivalent to a sliding by the amount 0.7d in the plane of the ramp bar. As a consequence, a small demultiplication is produced which is favorable to the precision of the adjustment and a better accessibility of the adjustment means. The inclination of the plane of the ramps and of the wedges is about 6° with respect to the direction of the axes of the rolls (namely, again, a slope of about 10% with respect to the direction of sliding of the ramp bar). From this value of slope, it follows that the vertical displacement of the movable assembly 12 is ten times less than the movement of ramp bar 21 which causes it.

By way of example, a quarter of a turn of crank 43 will have the effect of modifying the stroke of the bar by one millimeter and the stroke of the movable assembly by a tenth of a millimeter. This precision is not excessive since it is conducive to obtaining the desired radius of bend and therefore the proper subsequent operation of automatic welding or other devices.

Figure 4:
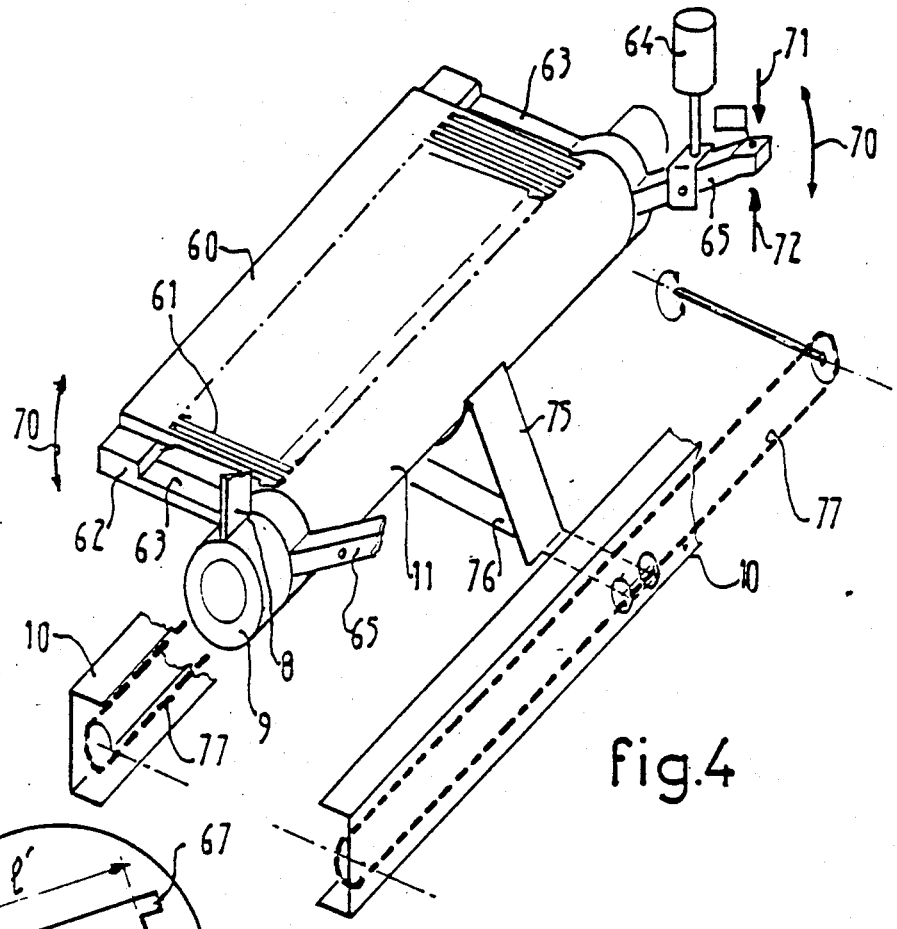
FIG. 4 is a perspective view showing the support roll of the bending machine of FIG. 2, associated with means for the ejection of the bent sheets.
Figure 5A:
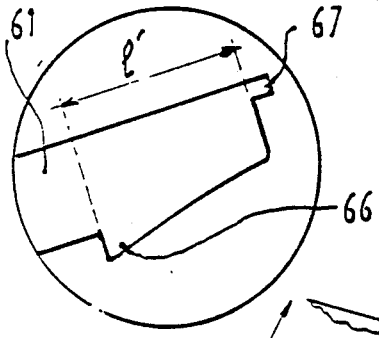
FIG. 5*a* shows a detail of a tooth of the comb shown in FIG. 4.
Figure 5:
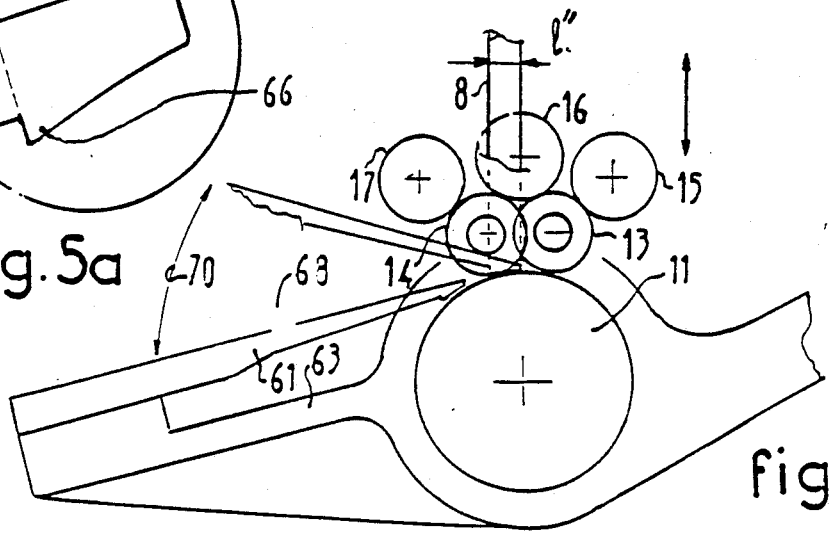
FIG. 5 is a diagrammatic end view, comparable to FIG. 3, illustrating the details of certain parts shown in FIG. 4.

In FIGS. 4 and 5, there are shown the assembly which participates in loading (introduction of the sheet between the rolls) and in unloading this sheet. The assembly takes the form of a comb 60 provided with teeth 61, also known as harpoons by reason of their shape and their function, supported by a U-shaped frame 62 having arms 63 of which are articulated on the ends of support roll 11. Cylinder-piston units 64 engage extensions 65 of arms 63 in order to impart to these arms a pivoting movement around the axis of roll 11 (arrows 70). Each tooth, or harpoon 61, as shown in FIG. 5*a*, has below its end a notch 66 and a protruding rim 67. The width 1′ of notches 66 is equal to or slightly greater than the thickness 1″ if the support web 8 of bearing 9. In FIG. 5 it will be noted that plane 68 defined by the upper face of harpoons 61 is substantially tangent to roll 11, and that the line of tangency is very close to the line of contact of the crenelated roll 14 when frame 62 is in lowered position. The notches 66, which are tangent to support roll 11, are aligned with the support web 8 when the frame is in raised position.

Thus, in the lowered position, at the start of the cycle (FIGS. 8*a* and 8*b*), the comb serves as guide table for the sheet S to be bent in a direction towards the rolls. In the raised position, at the end of the cycle (FIGS. 8*c* and 8*d*), notches 66 keep the linear edges of the bent sheet separated and align these edges on each side of the support web. The pivoting of the frame, limited by adjustable stops 71, 72 (FIG. 4), is very precise, and this precision permits the automatic extraction of the sheet after bending. This extraction is effected by a pusher 75 which brushes against the lower face of the support roll 11; the pusher is supported by a carriage 76 driven in forward and backward direction by a pair of chains 77 in rails 10, as shown in FIG. 4.

Thus the arrangement is such that the radius of bend of the sheet can be adjusted by operating a single member, the ramp bar, thereby eliminating the necessity of trial and error.

Furthermore, a bending machine in accordance with the invention effects bending in a single pass, and the subsequent automatic ejection. Due to the precise positioning of the harpoons, this leads to a considerably reduced cycle time of an operation. The precision of the radius of bend and the precision of the parallelism of the linear edges facing each other makes it possible to attach any automatic ring welding machine directly to the machine (that is to say, without intermediate handling).

It will be noted that the assembly 31 included in the invention (FIG. 2) intended for the adjustment of the radius of bend could by automatic means be indexed at the angular position in rotation of support roll 11, which is also a drive roll. As a consequence, the radius of bend can vary during the course of a cycle so as to make it possible to obtain a more or less elliptical or oval cylinder. These means may, for instance, be of the piston-cylinder type fed via servo-valves, or of the ball-screw type for the operation of the ramp bar and DC motor. The drive of the adjustment means will then preferably be of digital type. Obviously, the drive could also be of analog type by a mechanical transmission of the movement of the support roll to the ramp bar.

Although a preferred embodiment of a bending machine in accordance with the invention has been described and shown, it is to be understood that the scope of the invention is not limited to that embodiment and that it extends to any machine for the working of metals or other deformable materials comprising the general features set forth above, either separately or in combination.

I claim:

1. A bending machine adapted to shape a deformable flat sheet into a cone or cylinder, said machine comprising:

(a) a driven rotatable support roll, (b) an assembly of rolls movable relative to the support roll and including a pair of cooperating crenelated rolls penetrating into each other and having parallel axes, the said machine including a comb having an array of teeth which extend tangentially to the support roll to provide a guide table for the sheet to be bent which is fed between the support roll and the crenelated rolls, said teeth having end notches which can enter the space between opposing edges of the bent sheet and thereby separate these edges, and (c) a train of three press rolls subjecting said crenelated rolls to pressure and having axes parallel to the axes of the crenelated rolls, namely a central press roll which simultaneously presses on each of the crenelated rolls and lateral rolls, each of which is pressed against a respective crenelated roll, the line of contact between the press rolls and the crenelated rolls being located above the plane defined by the axes of the crenelated rolls, the axes of the press rolls and of the crenelated rolls being substantially fixed with respect to each other, said comb serving as a guide surface for the flat sheet before its passage between the crenelated and press rolls, and wherein the said comb is supported by a frame articulated at each of its ends around the support roll.

2. A bending machine as set forth in claim 1, wherein the same frame has arms the extensions of which are engaged with piston-cylinder units which impart to these arms a pivoting movement around the axis of the support roll.

3. A bending machine as set forth in claim 1, wherein said press rolls and said crenelated rolls are arranged in a plurality of coaxial trains, the ends of each train being supported by end support plate bearings and intermediate points in the train being supported by intermediate support plate bearings integral with a movable beam which is movable vertically.

4. A bending machine as set forth in claim 3, wherein a plurality of first ramps are provided along the edge of a ramp bar that is movable in a direction parallel to the axis of rolls, and an identical plurality of second ramps each formed by a sloped wedge which is integral with the said moving beam, each wedge having independent means for positioning in a direction parallel to that of the axes of the rolls.

5. A bending machine as set forth in claim 4, wherein the said means for positioning a sloped wedge is formed by a slideway having a plane parallel to the plane of the axes of the crenelated rolls and oriented at about 45° with respect of said axes.

6. A bending machine as set forth in claim 1, further including a pusher to extract a sheet after bending.

7. A bending machine as set forth in claim 6, wherein the pusher is supported by a carriage driven on a rail in a forward and backward direction by a pair of chains.

* * * * *